United States Patent [19]

Cantrell et al.

[11] Patent Number: 4,503,869

[45] Date of Patent: Mar. 12, 1985

[54] CIGARETTE MOUTHPIECE

[75] Inventors: Daniel V. Cantrell, Prospect; Herman G. Bryant, Jr., Louisville; Robert L. Jones, Louisville; Marco A. Maccaferri, Louisville; William M. McDaniel, Louisville, all of Ky.

[73] Assignee: Brown & Williamson Tobacco Corporation, Louisville, Ky.

[21] Appl. No.: 503,120

[22] Filed: Jun. 10, 1983

[51] Int. Cl.[3] ..... A24F 3/04

[52] U.S. Cl. ..... 131/336; 131/339; 131/344; 131/216

[58] Field of Search ..... 131/336, 339, 340, 344, 131/210, 211, 216

[56] References Cited

U.S. PATENT DOCUMENTS 4,023,576 5/1977 Norman ..... 131/339

*Primary Examiner*—V. Millin

*Attorney, Agent, or Firm*—Charles G. Lamb

[57] ABSTRACT

A cigarette mouthpiece of substantially cylindrical configuration assembled of two identical semi-cylindrical sections disposed in mutual concavely facing relationship with each longitudinal edge of one section in abuttment with a different one of the longitudinal edges of the other section. When assembled into a mouthpiece, the semi-cylindrical sections cooperate to define a plurality of generally longitudinally extending air ventilation grooves equally spaced from each other around the perimeter of the mouthpiece and a plurality of smoke flow capillaries extending generally longitudinally through the mouthpiece.

31 Claims, 11 Drawing Figures

CIGARETTE MOUTHPIECE

BACKGROUND OF THE INVENTION (1) Field of the Invention

The present invention relates to mouthpieces for cigarettes, and more particularly to a mouthpiece construction providing separate flow paths of ventilating air and smoke to the mouth end of the mouthpiece.

(2) Description of the Prior Art

Mouthpieces for cigarettes are known in the art.

An example of a known mouthpiece is shown in U.S. Pat. No. 3,552,399. The mouthpiece device therein referred to as a filter for homogenizing air and smoke has a blind ended, longitudinal, central axial passageway open to either the smoker's mouth or a filter element, a plurality of longitudinal passageways surrounding and extending parallel to the central passageway, and traverse passageways interconnecting the longitudinal passageways and central passageway with each other and with the ambient. As the cigarette to which the mouthpiece device is smoked, smoke and ambient air traverses the longitudinal and control passageways wherein the smoke and air are mixed before delivery to the smoker's mouth.

Another example of a mouthpiece is shown in U.S. Pat. No. 3,062,220, therein referred to as a plug, as including a pair of hollow, substantially semi-cylindrical exterior wall parts integrally joined together along one longitudinal edge of each wall part by a flexible hinge. When the wall parts are folded upon one another they form a hollow, substantially cylindrical tube. Each wall part is formed with one-half of a transverse jet partition which cooperate to define a transverse jet partition across the interior of the tube. One of these half partitions is formed with an aperture jet to allow smoke to pass through the partition. In addition, one of the wall parts has an impingement baffle spaced longitudinally from the jet partition which extends transversely of the interior of the tube with its free edge terminating short of the wall surface of the other wall part to define a smoke opening of greater cross-sectional area than the jet opening. When a cigarette to which this mouthpiece is attached is smoked, smoke passes at a high velocity through the off-center jet aperture in the jet partition and impinges in a substantially straight line direction against the surface of the baffle. The smoke expands in the area between the jet partition and baffle, and passes through the smoke opening between the free edge of the baffle and wall surface of the other wall part. Smoke solids and liquids are impelled against the partition and baffle and adhere thereto. The two wall parts are held together in the folded position by either heat sealing the abutting longitudinal free edges of the wall parts or by forming the longitudinal free edge of one wall part with a tongue which is received in a longitudinal groove formed in the longitudinal free edge of the other wall part. It should be noted that the wall parts are entirely different in configuration.

Yet another example of a mouthpiece is shown in U.S. Pat. No. 4,023,576 as formed of a pair of semi-cylindrical shells hinged together at one longitudinal edge of each shell. The sheels are folded upon each other to form a hollow cylindrical mouthpiece defining a smoke chamber. The smoke chamber is separated from the tobacco column by two longitudinally spaced apart baffle plates, one baffle plate projecting into the chamber from one of the shells and the other baffle plate projecting into the chamber from the other one of the shells, to define a curved path which the smoke must traverse before entering the smoke chamber. The mouth end of the smoke chamber is closed by a wall having a control orifice for the flow of smoke out of the smoke chamber into the smoker's mouth. The wall is defined by a half wall projecting from one shell and another half wall projecting from the other wall such that the terminating edges of the half walls abutt. The exterior surface of each shell is formed with longitudinal grooves which are open at the mouth end of the mouthpiece and which cooperate with an overlaying perforated tipping paper to form ventilating air flow paths. The two shells are held together in the folded position by slots formed in one shell along the free longitudinal edge which receives tab projecting from the free longitudinal edge of the other shell. It should be noticed that the shells are differently configured from each other.

SUMMARY OF THE INVENTION

The present invention provides a mouthpiece for a cigarette which provides for separate flow streams of ventilating air and smoke.

The present invention further provides a mouthpiece assembly of two identically sized and configured halfs.

More particularly, the present invention provides a generally cylindrical mouthpiece having a mouth end and a smoke inlet end adapted for use with a smoking article comprising two identically configured and sized semi-cylindrical scetions disposed in mutual concavely facing relationship with each longitudinal edge of one section in abuttment with a different one of the longitudinal edges of the other section, and means associated with the semi-cylindrical sections cooperating to define at least one smoke flow capillary.

BRIEF DESCRIPTION OF THE DRAWINGS

A better understanding of the present invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
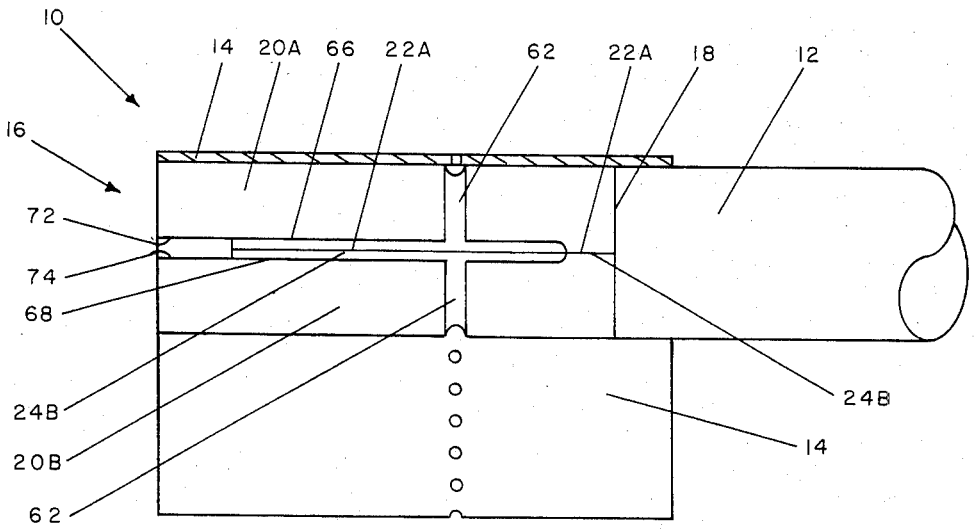
FIG. 1 is a side view of the mouthpiece of the present invention attached to a cigarette tobacco column with the tipping material partially unwound to show details.

With reference to FIGS. 1–4, the present invention provides a cylindrical mouthpiece, generally denoted as the numeral 10, adapted to be attached to a cigarette tobacco column 12 by means of, for example, air permeable tipping material 14 circumscribing the mouthpiece 10 and overlapping a portion of the tobacco column 12 adjacent to the interface of the mouthpiece 10 and tobacco column 12. In FIG. 1, the tipping material 14 is shown as being partially unwound to more clearly illustrate the interrelationship of the mouthpiece 10, tobacco column 12 and tipping material 14. When attached to a tobacco column 12, the mouthpiece 10 has a mouth end 16 and a smoke inlet end 18 abutting the tobacco column 12.

As can be best seen in FIGS. 2 through 5, the cylindrical mouthpiece 10 is formed of two identically sized and configured semi-cylindrical sections 20A and 20B. When assembled to form the mouthpiece 10, the two semi-cylindrical sections 20A and 20B are in mutually concavely facing relationship with each longitudinal edges 22A and 24A of one semi-cylindrical section 20A in longitudinal abuttment with a different one of the longitudinal edges 22B and 24B of the other one of the semi-cylindrical sections 20B.

For the reason that the semi-cylindrical sections 20A and 20B are identical, for the sake of brevity and clarity, the following discussion will describe only one section, denoted as the generic numeral 20.

Figure 4:
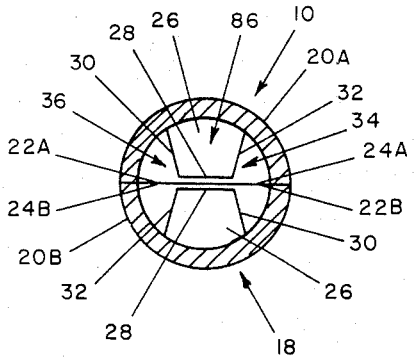
FIG. 4 is a view of the other end of the present invention as seen in the direction of arrows 4—4 in FIG. 2.
Figure 5:
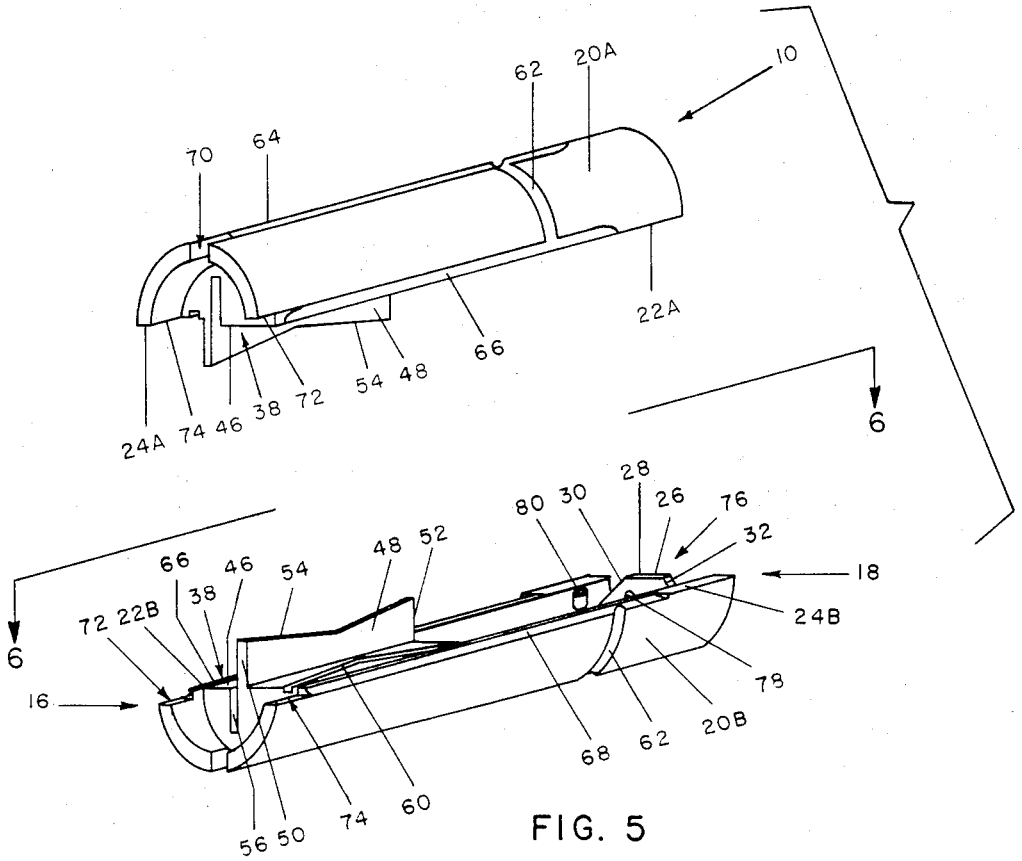
FIG. 5 is an exploded perspective view of the mouthpiece of FIG. 2.
Figure 6:
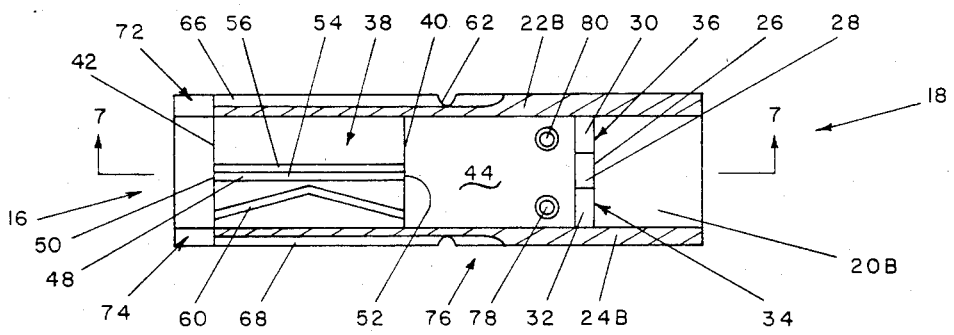
FIG. 6 is a plan view of a component of the present invention as seen in the direction of arrows 6—6 in FIG. 5.

As can be best seen in FIGS. 5 and 6, the semi-cylindrical section 20 includes a transverse partial wall 26 near the end of the semi-cylindrical section 20 which constitutes the mouth end 16 of the assembled mouthpiece 10. The partial wall 26 projects from the concave surface of the semi-cylindrical section 20 with its projecting transverse edge in the plane containing the longitudinal edges 22 and 24 of the semi-cylindrical section 20. The transverse partial wall 28 does not completely traverse the cross-sectional area of the semi-cylindrical section 20 but terminates in opposite side edges 30 and 32 each spaced from the adjacent wall surface of the semi-cylinder section 20 to define two spaced apart smoke flow through openings 34 and 36 between the side edges 30 and 32, respectively, and the wall surface of the semi-cylindrical section 20 adjacent thereto. A relatively thick transverse partition 38 projects from the concave side of the semi-cylindrical section 20 with one of its transverse surface 40 longitudinally spaced apart from the transverse partial wall 26 and its opposite transverse surface 42 spaced longitudinally inwardly from the end of the semi-cylindrical section 20 which constitutes the mouth end 16 of the assembled mouthpiece 10. The transverse surface 40 of the transverse partition 38 cooperates with the transverse partial wall 26 to define a smoke plenum half 44 therebetween. The transverse partition 38 terminates at a surface 46 generally in the plane containing the longitudinal edges 22 and 24 of the semi-cylindrical section 20. In addition, a longitudinal wall 48 also projects to the concave side of the semi-cylindrical section 20 from the terminating surface 46 of the transverse partition 40. The longitudinal wall 48 is spaced to one side of and substantially parallel to the longitudinal centerline of the semi-cylindrical section 20. As shown, the longitudinal wall 48 is integrally formed with the transverse partition 38 and is longitudinally co-extensive with the transverse partition such that the longitudinal wall 48 has an upstream edge 50 spaced from the transverse partial wall 26 and a downstream edge 52 spaced longitudinally inwardly from the end of the semi-cylindrical section 20 which constitutes the mouth end 16 of the assembled mouthpiece 10. It should be noticed that the longitudinal wall 48 terminates at a longitudinal edge 54 beyond the plane containing the longitudinal edges 22 and 24 of the semi-cylindrical section 20. As can be most clearly seen in FIG. 4, the longitudinal edge 54 of the longitudinal wall 48 is chevron shaped sloping from both the upstream edge 50 and downstream edge 52 downwardly toward the center of the longitudinal wall 48.

Figure 7:
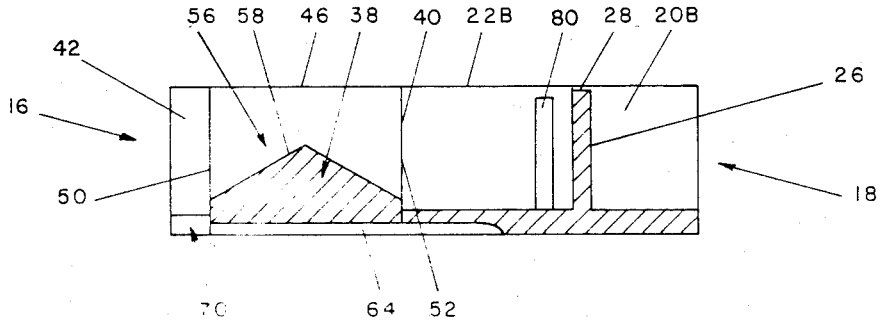
FIG. 7 is a cross-sectional view as seen in the direction of arrows 7—7 in FIG. 6.

With continued reference to FIGS. 5, 6 and 7, a generally longitudinally extending slot 56 if formed in the transverse partition 38 to the other side of the longitudinal centerline of the semi-cylindrical section 20 from the longitudinal wall 48. The longitudinal slot 56 is open at one of its ends at the transverse surface 40 of the partition wall 38 to the smoke plenum half 44, open at its opposite end at the transverse surface 42 of the partition 38 and open at the terminating surface 46 of the partition wall 38 along its entire length. The depth of the longitudinal slot 56, as measured from the terminating surface 46 of the transverse partition 38 to the bottom surface 58 is greater than the distance by which the longitudinal wall 48 projects beyond the plane containing the longitudinal edges 22 and 24 of the semi-cylindrical section 20. As can be seen in FIG. 6, the bottom surface 58 of the longitudinal slot 56 is chevron shaped substantially complimentary to the chevron shape of the terminating longitudinal edge 54 of the longitudinal wall 48. The bottom surface 58 slopes generally upwardly in the slot 56 from each of the open ends of the slot 56 toward the center of the slot 56.

As can be seen in FIGS. 4 and 5, a channel 60 is formed in the transverse partition 38 next to the longitudinal wall 48 on the other side thereof from the longitudinal slot 56. The channel 60 is open at one of its ends at the transverse surface 40 of the partition wall 38 to the smoke plenum half 44, open at its opposite end at the transverse surface 42 of the partition wall 38 and open into the terminating surface 46 of the partition 38 along its entire length. The channel 60 follows a chevron shaped path which is substantially conforming to the chevron shape of the terminating longitudinal edge 54 of the longitudinal wall 48. As shown in FIG. 5, the channel 60 slopes from each of its open ends toward the longitudinal wall 48 at the center of the channel 60. The depth of the channel 60 is substantially equal to the difference between the depth of the longitudinal slot 56 and the distances by which the longitudinal wall 48 projects beyond the plane containing the longitudinal edges 22 and 24 of the semi-cylindrical section 20.

As can be seen in FIGS. 1 through 6, the semi-cylindrical section 20 is formed with a semi-annular groove 62 in its convex surface open to the perimeter or the semi-cylindrical section 20 and open at its opposite ends to the longitudinal edges 22 and 24 of the semi-cylindrical section 20. As shown, the semi-annular groove 62 is located closer to the end of the semi-cylindrical section 20 constituting the smoke inlet end 18 of the assembled mouthpiece 10 than to the other end of the semi-cylindrical section 20.

With reference particularly to FIGS. 2, 3, 5 and 7, the semi-cylindrical section 20 is formed with at least one generally longitudinally extending grooves 64 formed in and open to the convex surface of the semi-cylindrical section 20. The longitudinal groove 64 is open, proximate one of its ends, to the semi-annular groove 62 and extends therefrom generally along the longitudinal center line of the semi-cylindrical section 20 toward that end of the semi-cylindrical section 20 which constitutes the mouth end 16 of the assembled mouthpiece 10.

Figure 2:
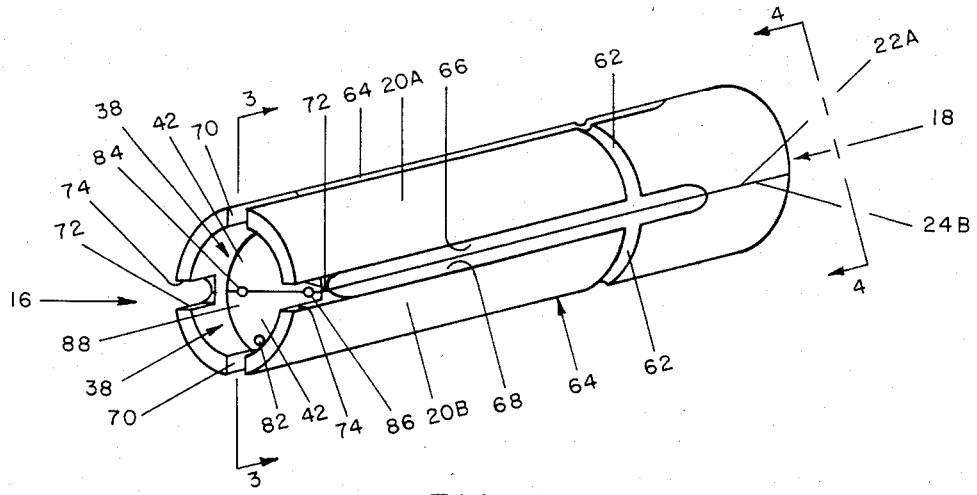
FIG. 2 is a perspective view of the mouthpiece of the present invention.
Figure 3:
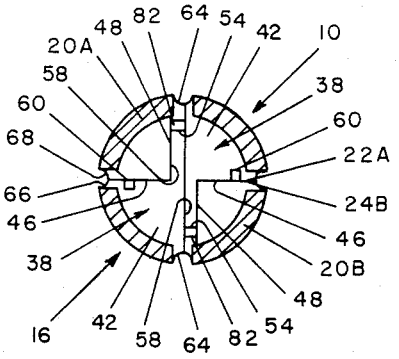
FIG. 3 is a view of one end of the present invention as seen in the direction of arrows 3—3 in FIG. 2.

With continued reference to FIGS. 2, 3, 5 and additionally FIG. 6, the semi-cylindrical section 20 is formed with two generally longitudinally extending half width grooves 66 and 68 each of which is half as wide as the longitudinal groove 64. As shown, the half width groove 66 is open, proximate one of its ends, to the semi-annular groove 62 and extends generally along the longitudinal edge 22 of the semi-cylindrical section 20 toward that end of the semi-cylindrical section 20 which constitutes the mouth end 16 of the assembled mouthpiece 10. The half width groove 66 is also open to the convex surface of the semi-cylindrical section 20 and to the longitudinal edge 22 of the semi-cylindrical section 20. Similarly, the half width groove 68 is open, proximate one of its ends, to the semi-annular groove 62 and extends generally along the other longitudinal edge 24 of the semi-cylindrical section 20 toward that end of the semi-cylindrical section 20 which constitutes the mouth end 16 of the assembled mouthpiece 10. The half width groove 68 is also open to the convex surface of the semi-cylindrical section 20 and to the longitudinal edge 24 of the semi-cylindrical section 20.

As can be seen in FIGS. 1 through 7, the open ends of the longitudinal groove 64 is recessed from that end of the semi-cylindrical section 20 which constitutes the mouth end 16 of the assembled mouthpiece 10. Toward this end, a cavity 70 is formed at the mouth end of the semi-cylindrical section 20 in communication with the open end of the longitudinal groove 64.

Similarly, as can also be seen in FIGS. 1 through 7, the open end of each of the half width grooves 66 and 68 is recessed from the end of the semi-cylindrical section 20 which constitutes the mouth end 16 of the assembled mouthpiece 10. This is accomplished by forming a half-width cavity 72 at the mouth end of the semi-cylindrical section 20 in communication with the open end of the half width groove 66 and a half width cavity 74 at the mouth end of the semi-cylindrical section 20 in communication with the open end of the half width groove 68. It should also be noticed that the half width cavity 72 is open to the longitudinal edge 24 of the semi-cylindrical section 20.

As can be most clearly seen in FIGS. 6 and 7, the semi-cylindrical section 20 includes fastening means, generally denoted as the numeral 76, located on the concave side of thereof near the transverse partial wall 26. As shown, the fastening means 76 includes a plug 78 and a socket means 80. The plug 78 is laterally spaced to one side of the longitudinal centerline of the semi-cylindrical section 20 and projects from the concave surface beyond the plane containing the longitudinal edges 22 and 24 of the semi-cylindrical section 20. The socket means 80 is a hollow cylindrical column laterally spaced to the other side of the longitudinal centerline of the semi-cylindrical section 20 and projects from the concave surface to approximately the place containing the longitudinal edges 22 and 24 of the semi-cylindrical section 20.

As can be best seen by reference to FIGS. 1 through 6, the mouthpiece 10 is formed by assembling the two semi-cylindrical sections 20A and 20B together in mutual concavely facing relationship. The two identical semi-cylindrical sections 20A and 20B are oriented in what can best be termed a mirror image relationship as can be seen in FIG. 5 with the longitudinal edges 22A and 24A of section 20A in longitudinal abuttment with the longitudinal edges 24B and 22B, respectively, of the other section 20B. In this position, the longitudinal wall 48 of section 20A is received in the longitudinal slot 56 in the other section 20B and the longitudinal wall 48 of section 20B is received in the longitudinal slot 56 in the section 20A such that the longitudinal walls 48 of the sections 20A and 20B are in side-by-side abutting relationship (see FIG. 3). It should be noted that since the depth of each longitudinal slot 56 is greater than the distance each longitudinal wall 48 projects beyond the plane containing the longitudinal edges 22 and 24 of the sections 20A and 20B, the terminating longitudinal edge 54 of each longitudinal wall 48 will be spaced from the bottom surface 58 of the longitudinal slot 56 in which it is received. Thusly, the terminating edge 54 of each longitudinal wall 48 cooperates with the bottom surface 58 of the longitudinal slot 56 in which it is received to define a generally longitudinal smoke flow capillary 82. The two smoke capillaries 82 are disposed generally diametrically across the mouthpiece 10 from each other. Further, because the terminating edge 54 of each longitudinal wall 48 is generally chevron shaped and the bottom surface of each longitudinal slot 56 receiving the longitudinal wall 48 is complimentarily chevron shaped, the capillaries 82 each have a bent longitudinal axis oriented such that the portion of each smoke flow capillary 82 is angled to direct smoke flowing therethrough generally radially outwardly of the mouthpiece 10 toward the mouth end 16 thereof. In addition, the channel 60 in the partition wall 38 of each section 20A and 20B is closed along its length by the terminating surface 46 of the partition wall 38 of the other section, thus, defining two generaly longitudinal smoke flow capillaries 84. The two smoke flow capillaries 84 are disposed generally diametrically across the mouthpiece 10 from each other. Becuase of the chevron shape of the channels 60, the capillaries 84 formed thereby have a bent longitudinal axis oriented such that the portion of each smoke flow capillary 84 is angled to direct smoke flowing therethrough generally radially outwardly of the mouthpiece 10 toward the mouth end 16 thereof. As can be best seen on FIGS. 2, 4 and 5, the transverse partial walls 26 of the semi-cylindrical sections 20A and 20B project toward each other with their respective transverse edges 28 in close proximity to each other to form a transverse wall segment 86 across a portion of the mouthpiece 10 near the smoke inlet end 18. Similarly, the thick transverse partition walls 38 meet at their terminating surfaces 46 to form a transverse wall 88 across the mouthpiece 10 spaced longitudinally of the mouthpiece 10 from the transverse wall segment 86. The smoke plenum halfs 44 of the semi-cylindrical sections 20A and 20B cooperate to form a smoke plenum chamber 90 between the transverse wall segment 86 and transverse wall 88. The smoke flow-through openings 34 and 36 adjacent to the side edges 30 and 32 of the partial wall 26 of section 20A associated with the smoke flow-through openings 36 and 34, respectively, adjacent to the side edges 32 and 30 of the partial wall 26 of section 20B to provide for the flow of smoke from the tobacco column 12 into the plenum chamber 90 past the transverse wall segment 86.

Referring now to FIGS. 1, 2 and 3, when the semi-cylindrical sections 20A and 20B are assembled, the half-width groove 66 along the longitudinal edge 22A of semi-cylindrical section 20A cooperates with the half-width groove 68 along the longitudinal edge 24B of semi-cylindrical section 20B to form a full width groove of substantially the same width as the longitudinal groove 64. And likewise, the half-width groove 68 along the longitudinal edge 24A of semi-cylindrical section 20A cooperates with the half-width groove 66 along the longitudinal edge 22B of semi-cylindrical section 20B to form another full width groove of substantially the same width as the longitudinal groove 64. Thus, four essentially identical grooves are located in the peripheral surface of the mouthpiece 10 generally equally circumferentially spaced apart from each other. In addition, the half width cavity 72 at the outlet end of the half-width groove 66 in the semi-cylindrical section 20A cooperates with the half-width cavity 74 at the outlet end of the half-width groove 68 in the semi-cylindrical section 20B to form a complete cavity of essentially the same size as the cavity 70 at the outlet end of the groove 64, and the half-width cavity 74 at the outlet end of the half-width groove 68 in the semi-cylindrical section 20A cooperates with the half-width cavity 72 at the outlet end of the half-width groove 66 in the other semi-cylindrical section 20B to also form a complete cavity of essentially the same size as the cavity 70 at the outlet end of the groove 64. Thus, the outlet end of all grooves formed in the peripheral surface of the mouthpiece 10 are recessed from the mouth end 16 of the mouthpiece 10. These grooves function as ventilating air flow paths to the mouth end 16 of the mouthpiece 10. The open ends of the semi-annular groove 62 in one of the semi-cylindrical sections 20A are each in registration with a different one of open ends of the semi-annular groove 62 in the other semi-cylindrical sections 20B to form an annular groove about the perimeter of the mouthpiece 10. When the cigarette of FIG. 1 is smoked, ventilating air passes through the permeable tipping material 14 and into the annular groove. The ventilating air then moves from the annular groove althrough the longitudinal grooves to the mouth end 16 of the mouthpiece 10 whereat it is discharged into the smoker's mouth to co-mingle with the unfiltered smoke exiting the smoke flow capillaries.

The two identical semi-cylindrical sections 20A and 20B are retained in mutual concavely facing relationship, at least in part, by the friction between the longitudinal walls 48 and the longitudinal slots 56. However, it may be desirable to include additional fastener means 76 near the inlet end 18 of the mouthpiece 10. As can be best visualized by reference to FIGS. 5 6, the plug 78 of one semi-cylindrical section 20A is received in the socket means 80 of the other semi-cylindrical section 20B, and the plug 78 of the semi-cylindrical section 20B is received in the socket means 80 of the semi-cylindrical section 20A to attach the sections 20A and 20B together near the smoke inlet end 18 of the mouthpiece.

Figure 8:
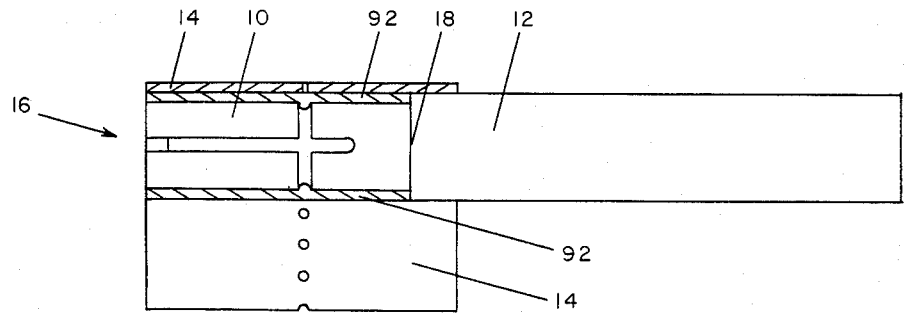
FIG. 8 is a side view of the mouthpiece of the present invention attached to a cigarette tobacco column with the tipping material partially unwound and with the wrapper material exaggerated and in cross-section to clearly show one advantageous feature.
Figure 9:
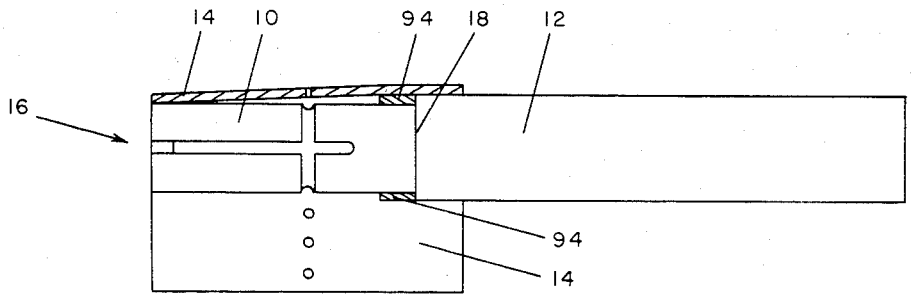
FIG. 9 is another side view of the mouthpiece of the present invention attached to a tobacco column with the tipping material partially unwound and with the wrapper material exaggerated and in cross-section to clearly show another advantageous feature.
Figure 10:
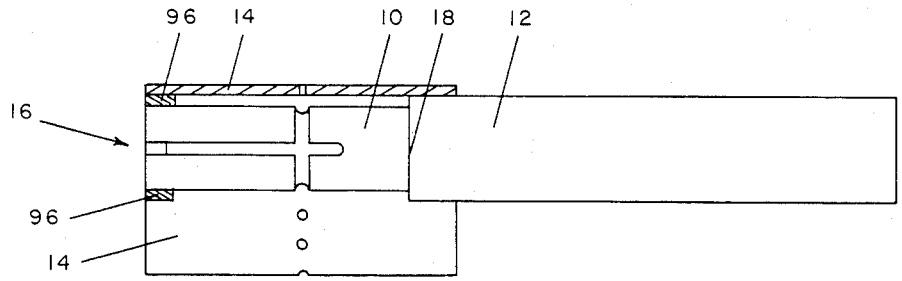
FIG. 10 is a further side view of the mouthpiece of the present invention attached to a tobacco column with the tipping material martially unwound and with the wrapper material exaggerated and in cross-section to clearly show a further advantageous feature.
Figure 11:
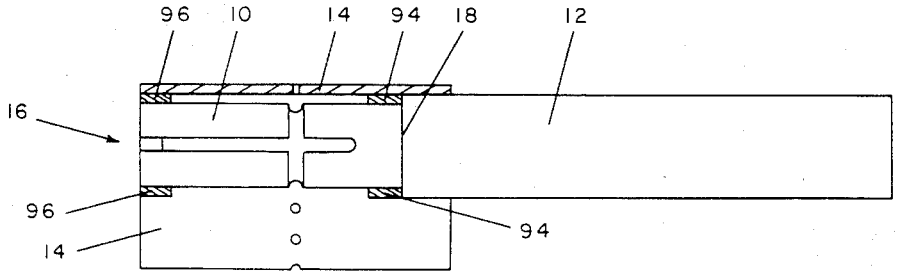
FIG. 11 is still a further side view of the mouthpiece of the present invention attached to a tobacco column with the tipping material partially unwound and with the wrapper material exaggerated and in cross-section to clearly show a still further advantageous feature.

With reference to FIGS. 8 through 11, it has been found that to assure secure fastening of the mouthpiece 10 to the tobacco column 12 it is advantageous to employ a circumscribing layer of wrapper material between the peripheral surface of the mouthpiece 10 and the tipping material 14. Examples of such wrapper material are air permeable plug wrap and air impermeable plug wrap. FIG. 8 shows a circumscribing wrapper sleeve 92 of air permeable plug wrap which extends longitudinally along the mouthpiece 10 from the mouth end 16 to the smoke inlet end 18. FIG. 8 shows a circumscribing wrapper band 94 of either air permeable or impermeable plug wrap located at the smoke inlet end 18 of the mouthpiece 10. FIG. 10 shows a circumscribing wrapper band 96 of either air permeable or air impermeable plug wrap located at the mouth end 16 of the mouthpiece 10. FIG. 11 illustrates a circumscribing wrapper band 94 of either air permeable or air impermeable plug wrap located at the smoke inlet end 18 of the mouthpiece 10 as well as a circumscribing wrapper band 96 of either air permeable or air impermeable plug wrap located at the mouth end 16 of the mouthpiece 10.

The foregoing detailed description if given primarily for clearness of understanding and no unnecessary limitations are to be understood therefrom for modifications will become obvious to one skilled in the art upon reading this disclosure and may be made without departing from the spirit of the invention and scope of the appended claims.

What is claimed is:

1. A generally cylindrical mouthpiece having a mouth end and a smoke inlet end adapted for use with a smoking article, comprising:

two identically configured and sized semi-cylindrical sections disposed in mutual concavely facing relationship with each longitudinal edge of one section in abuttment with the opposed longitudinal edge of the other section; and, means associated with the semi-cylindrical sections cooperating to define at least one smoke flow capillary.

2. The mouthpiece of claim 1, further comprising means defining a smoke plenum chamber upstream, relative to the direction of smoke flow through the mouthpiece, from the smoke flow capillary defining means.

3. The mouthpiece of claim 1, wherein the smoke outlet of the at least one smoke flow capillary is recessed from the mouth end of the mouthpiece.

4. The mouthpiece of claim 1, wherein such semi-cylindrical section of the mouthpiece is formed with at least one generally longitudinally extending ventilation air groove at the concave surface having an air outlet end open to the mouth end of the mouthpiece.

5. The mouthpiece of claim 4, wherein the air outlet end of the at least one ventilation air groove is recessed from the mouth end of the mouthpiece.

6. The mouthpiece of claim 4, wherein each semi-cylindrical section of the mouthpiece is formed with a semi-annular groove at the concave surface;

the generally longitudinally extending ventilation air groove in each semi-cylindrical section is open to the semi-annular groove formed in the same semi-cylindrical section; and, the semi-annular grooves cooperate to form an annular ventilation air groove circumscribing the mouthpiece.

7. The mouthpiece of claim 1, wherein:

each semi-cylindrical section is formed with one half width groove extending at least part way along at least one of the longitudinal edges of the semi-cylindrical section open to at least one end of the semi-cylindrical section; and, the half width grooves register to form a generally longitudinally extending full width ventilation air groove at the concave surface of the mouthpiece having an air outlet end open to the mouth end of the mouthpiece.

8. The mouthpiece of claim 7, wherein:

the open end of each half width groove in each semi-cylindrical section is recessed from the end of the semi-cylindrical section; and, the recessed open ends of the registered half width grooves cooperate to form the outlet end of the ventilation air groove recessed from the mouth end of the mouthpiece.

9. The mouthpiece of claim 7, wherein:

each semi-cylindrical section of the mouthpiece is formed with a semi-annular groove at the concave surface;

the half width groove in each semi-cylindrical section is open to the semi-annular groove formed in the same semi-cylindrical section; and, the semi-annular grooves cooperate to form an annular ventilation air groove circumscribing the mouthpiece.

10. The mouthpiece of claim 1, wherein:

each of the semi-cylindrical sections comprise a transverse partial wall at one end;

the transverse partial walls cooperate to form a transverse wall segment proximate the inlet end of the mouthpiece; and, the transverse wall segment defines smoke flow-through openings into the mouthpiece.

11. The mouthpiece of claim 1, wherein the means cooperating to define at least one smoke flow capillary comprises:

a generally longitudinal wall projecting from the concave side of each semi-cylindrical section;

a generally longitudinal slot defined at the concave side of each semi-cylindrical section; and, the longitudinal wall of each semi-cylindrical section is received in the longitudinal slot of the other semi-cylindrical section with the terminating edge of the longitudinal wall spaced from the bottom surface of the longitudinal slot.

12. The mouthpiece of claim 11, wherein:

the longitudinal wall is disposed to one side of the longitudinal centerline of the semi-cylindrical section; and, the longitudinal slot is disposed to the other side of the longitudinal centerline of the semi-cylindrical section from the longitudinal wall.

13. The mouthpiece of claim 1, wherein the means cooperating to define at least one smoke flow capillary comprises:

a generally longitudinal channel formed in each semi-cylindrical section open along its length to the concave side of the semi-cylindrical section;

surface means formed at the concave side of each semi-cylindrical section; and, the surface means of each semi-cylindrical section overlays the open length of the longitudinal channel of the other semi-cylindrical section closing the open length of the channel.

14. The mouthpiece of claim 1, further comprising means for fastening the semi-cylindrical sections together.

15. The mouthpiece of claim 14, wherein the fastening means comprises:

a plug projecting from the concave side of each semi-cylindrical section;

socket means open to the concave side of each semi-cylindrical section; and, the plug of each semi-cylindrical section is received in the socket means of the other semi-cylindrical section.

16. The mouthpiece of claim 12, wherein the means cooperating to define at least one smoke flow capillary further comprises:

a generally longitudinal wall projecting from the concave side of each semi-cylindrical section;

a generally longitudinal slot defined at the concave side of each semi-cylindrical section; and, the longitudinal wall of each semi-cylindrical section is received in the longitudinal slot of the other semi-cylindrical section with the terminating edge of the longitudinal wall spaced from the bottom surface of the longitudinal slot.

17. The mouthpiece of claim 16, wherein:

the longitudinal slot is disposed to the one side of the longitudinal wall; and, the longitudinal channel is disposed to opposite side of the longitudinal wall from the longitudinal slot.

18. The mouthpiece of claim 1, each semi-cylindrical section and the means associated therewith for defining at least one smoke flow capillary are of unitary construction..

19. A cigarette comprising:

a generally cylindrical tobacco column;

a generally cylindrical mouthpiece of two identically configured and sized semi-cylindrical sections disposed in mutual concavely facing relationship defining a smoke inlet end and mouth end, the mouthpiece being coaxial with the tobacco column with the smoke inlet end being adjacent to one end of the tobacco column, each of the semi-cylindrical sections having identically configured and sized means which cooperate to define at least one smoke flow capillary through the mouthpiece, and the semi-cylindrical sections having means defining at least one ventilation air groove at the concave surface of the mouthpiece with an end open at the mouth end of the mouthpiece; and, air permeable tipping material circumscribing the generally cylindrical mouthpiece and overlapping a portion of the tobacco column adjacent to the smoke inlet end of the mouthpiece for attaching the mouthpiece to the tobacco column and allowing ventilation air be drawn into the at least one ventilation air groove upon smoking of the cigarette.

20. The cigarette of claim 19, further comprising a layer of wrapper material cicumscribing the mouthpiece and disposed between the periphery of the mouthpiece and the tipping material.

21. The cigarette of claim 20, wherein the circumscribing wrapper comprises sleeve of wrapper material extending longitudinally along the mouthpiece from the smoke inlet end of the mouthpiece to the mouth end of the mouthpiece.

22. The cigarette of claim 20, wherein the circumscribing wrapper comprises a band of wrapper material located proximate the smoke inlet end of the mouthpiece.

23. The cigarette of claim 22, wherein the circumscribing band of wrapper material is air impermable.

24. The cigarette of claim 22, wherein the circumscribing band of wrapper material is air permeable.

25. The cigarette of claim 20, wherein the circumscribing wrapper comprises a band of wrapper material located proximate the mouth end of the mouthpiece.

26. The cigarette of claim 25, wherein the circumscribing band of wrapper material is air impermeable.

27. The cigarette of claim 25, wherein the circumscribing band of wrapper material is air permeable.

28. The cigarette of claim 20, wherein the circumscribing wrapper comprises:

a band of wrapper materials located proximate the smoke inlet end of the mouthpiece; and, a band of wrapper material located proximate the mouth end of the mouthpiece.

29. The cigarette of claim 28, wherein at least one of the circumscribing bands of wrapper material is air impermeable.

30. The cigarette of claim 28, wherein at least one of the circumscribing bands of wrapper material is air permeable.

31. The cigarette of claim 20, wherein the circumscribing band of wrapper material is air permeable.

* * * * *